United States Patent [19]

Weihrauch

[11] Patent Number: 4,807,938

[45] Date of Patent: Feb. 28, 1989

[54] PROCESS FOR PRODUCING BRISTLE ARTICLES

[75] Inventor: Georg Weihrauch, Wald-Michelbach, Fed. Rep. of Germany

[73] Assignee: Coronet-Werke Heinrich Schlerf GmbH, Wald-Michelbach, Fed. Rep. of Germany

[21] Appl. No.: 132,369

[22] Filed: Dec. 14, 1987

[30] Foreign Application Priority Data

Dec. 18, 1986 [DE] Fed. Rep. of Germany ..... 3643202

[51] Int. Cl.[4] ..... A46D 1/04

[52] U.S. Cl. ..... 300/21

[58] Field of Search ..... 300/21, 2–11

[56] References Cited

U.S. PATENT DOCUMENTS 2,710,774 6/1955 Baumgartner ..... 300/2 X
3,408,112 10/1968 Piotrowski ..... 300/21

FOREIGN PATENT DOCUMENTS 845933 7/1949 Fed. Rep. of Germany .
1049823 7/1959 Fed. Rep. of Germany .
2849510 4/1980 Fed. Rep. of Germany .
3205641 12/1983 Fed. Rep. of Germany .

*Primary Examiner*—Mark Rosenbaum
*Attorney, Agent, or Firm*—Antonelli, Terry & Wands

[57] ABSTRACT

A process for the manufacture of bristle products, from multifilament bristle strands wound in the form of endless material onto reels. The bristle strands, after unwinding, are supplied to a processing station, where they are fixed to a bristle carrier either in continuous or cut to size form. The removal from the spools takes place by a holding or tensile force acting in timed manner on the bristle strands at the processing station. In order to eliminate the non-uniform lengths of the individual monofilaments due to manufacture or processing and which lead to loop formation during processing, at least during the holding cycles acting on the processing station, a tensile force directed counter to the holding force acts on all the bristle strands. This tensile force is set in such a way that the bristle strands and, preferably, also all the monofilaments within a bristle strand are stretched between the spools and the processing station.

13 Claims, 2 Drawing Sheets

PROCESS FOR PRODUCING BRISTLE ARTICLES

BACKGROUND OF THE INVENTION

The invention relates to a process for producing bristle articles, in which the multifilament bristle strands, wound as endless material onto spools, are fed to a processing station, where the bristles, either in endless or cut to size form, are fixed to a bristle carrier; by a holding or tensile force acting thereon in timed sequence at the processing station and accompanied by the unwinding from the spools.

Soon after the appearnce of plastics which could be processed to fibres, such plastic fibres were also used for bristles, which were previously made from natural materials. The conventional procedure was initially used, in that the fibres were brought together to form multifilament strands and then cut, as required, to bundles (cf. e.g. DE-OS No. 28 48 510). The fixing of the bristle bundles to bristle carriers also initially took place in a conventional manner, e.g. on filling machines (DE-AS No. 1 049 823), in which the bundles, folded in a hairpin-like manner were inserted into prepared holes of the bristle carrier and were mechanically fixed by clips or the like. The plastic bristles could also be fixed to the bristle carrier by glueing, cementing, etc.

With the advance of plastic moulding technology, e.g. injection moulding, foaming of moulds, etc., it became possible to manufacture the bristle carriers inexpensively by such moulding processes, which also offered new possibilities for fixing the bristles to the bristle carrier, in that the bristles were introduced with their processing-side end into the mould of the bristle carrier and were fixed by moulding round (cf. e.g. German Pat. No. 845 933 and U.S. Pat. Nos. 2,643,158 and 3,408,112). Finally, numerous attempts were made to join the plastic bristles to the bristle carrier by two-sided plasticizing and shaping, as well as directly welding the plastic bristles to the bristle carrier.

After plastic bristles had been produced in endless or continuous manner and wound in endless strand form onto spools, it was obvious to carry out the processing to bristle products from the endless strand. Either the bristle fibres in connection with manufacture were brought together to form multifilament strands, wound onto storage reels and fed in multifilament strand form to the processing station (all the aforementioned publications), or in connection with the manufacture individual spools were wound, were removed from the storage reels at the processing machine, were combined into bundles and then joined to the bristle carrier (U.S. Pat. Nos. 2,710,774 and 2,035,709).

All the proposals made up to now in connection with the endless processing to bristle material have not been successful in practice. The starting point for all the difficulties has been the fact that a large number of bristles must be fixed to the bristle carrier with its small surface, so that when processing from the endless material a corresponding number of monofilaments must be removed from a corresponding number of storage reels and brought together in a very confined space, secured by clamping and fixing device and fixed in timed sequence to the bristle carriers. The problems can be solved to a certain extent if the bristle bundles are individually filled, because then the bundles can be successively fixed. However, this process is uneconomical. It can in particular not be used if the bristles are injection moulded or moulded into the carrier material or are fixed to the bristle carrier by welding. In such cases, all the bristles must be applied to the bristle carrier in one timed operating cycle. For example in the case of a scrubbing means with 100 bristle bundles of in each case 100 individual bristles, this would lead to 100,000 monofilaments and therefore 100,000 spools, which is neither technically, nor economically feasible.

If, in place thereof, multifilament bristle strands are processed, although the number of strands to be supplied and the number of storage reels can be produced, but in the case of the above example there would still be 100 reels, the processing difficulties would not be reduced for the following reasons. The bristle fibres obtained by spinning are stretched following the spinning machine to a multiple of the length, in order to straighten the molecular structure and give the fibres the necessary elasticity. This is generally followed by stabilization, which takes place at a relatively high temperature and is intended to fix the molecular structure, so that, during subsequent thermal stressing of the bristles, no changes take place. The thus stretched and stabilized fibres are then brought together to a multifilament strand and wound up. The individual fibres have different lengths, so that not all fibres have the same length within the bristle strand. In addition, the wound fibres change their behaviour by cold flow, because the generally shrink. Moreover, the cold flow does not take place in a uniform manner for all the fibres of a multifilament strand, so that length differences occur on the actual spool. If such a multifilament bristle strand is now removed from the storage reel, then the tension transfer only takes place via the shortest fibres, whereas other fibres form loops or hang in slack form and become tangled, which also leads to constant blockages on the processing machine. Furthermore, the plurality of spools, 100 in the above example, have different distances from the processing station, so that each bristle strand has a different transport path, so that the extent of loop formation differs for each bristle strand. In addition, length differences occur during the actual transportation or conveying, in that the bristle strands frequently have to be deflected several times. This leads to speed differences between the individual bristle strands and therefore to length differences between them. However, also the monofilaments of a multifilament bristle strand are subject to different forces during each deflection process, so that even within an individual strand length differences occur during processing.

Attempts have been made to eliminate loop formation (German Pat. No. 32 05 641), in that the bristle strand is twisted, so that the monofilaments are present in helical form within the strand. There is up to one twist per running metre. This was able to reduce loop formation, but not eliminate it. A further disadvantageous effect occurs through storing the bristle strands on spools. Due to the aforementioned cold flow characteristics of plastics and the lack of creep resistance, the individual fibres undergo deformation corresponding to the winding radius on the spool. However, in general the bristles must be absolutely linear to be able to fulfil their intended use. Through cross-winding of the strands (German Pat. No. 32 05 641) it has proved possible to keep the radius of curvature as small as possible. It is also known to eliminate the curvature after removal from the storage reel in that the strand is heated (DE-OS No. 2 849 510) or the bristle strands are passed through straightening rolls (U.S. Pat. No. 2,643,158). However, with none of the known measures has it been possible to exclude loop formation which is prejudicial to continuous processing.

SUMMARY OF THE INVENTION

The aim underlying the present invention is to avoid the formation of loops or eliminate existing loops during the processing of multifilament endless strands to bristle products.

On the basis of the aforementioned process, in which the bristle strands are applied in timed sequence to the bristle carrier under the action of a holding force at the processing station, the problem of the invention is solved in that at least during the holding cycles acting on the processing station, a tensile force directed counter to the holding force and acting between the spools and the processing station is made to act on all the bristle strands and said tensile force is adjusted in such a way that the bristle strands are stretched between the spools and the processing station.

As a result of the invention process, the transport movement of the bristle strands, which is e.g. produced by tension on the processing station, is countered by a tensile force acting over the entire length. This tensile force or tension is dimensioned in such a way that the bristle strands are stretched or tightened between the spool and the processing station. Thus, length differences already existing on the spool are not transferred to the transport section and consequently can have no negative influence at the processing station. In addition, no loops can form as a result of the tension on the transport section. Existing length differences of the monofilaments within the strand are eliminated to such an extent that the strand assumes the length of the shortest monofilament within the strand. In addition, the curvatures of the bristle strand emanating from the spool are eliminated.

According to a preferred embodiment of the invention, the tension is set in such a way that when it acts on the bristle strands the firstly stretched monofilaments are expanded.

This embodiment more particularly makes use of the residual extension present in the monofilament as a result of its manufacture, so that the individual monofilament is not overstressed under the tensile action and in particular does not suffer from any contraction. In one of the known processes (DE-OS No. 2 849 510) a thread tension is admittedly produced between the storage reel and the feed drive connected downstream thereof, but this merely serves to utilize the heat acting on the strand between these two positions for straightening the latter. Thus, loop formation cannot be avoided, because the transportation to the processing station takes place under thrust and not under tension, so that existing length differences can exert their full disadvantageous effect. In addition, there are length differences of the individual monofilaments in the strand due to slip and speed differences at deflecting points.

According to a further development of the inventive process, the bristle strands and at least their outer monofilaments, are heated after unwinding from the spools and are cooled during their further travel to the processing station.

The heat does not or does not mainly serve to eliminate curvatures, such as is the case in the known process of DE-OS No. 2 849 510 and instead it serves to eliminate any overlengths of individual monofilaments still existing despite the tension applied by the shrinkage thereof. This procedure is particularly advantageous in the case of multifilament bristle strands, in which the individual fibres have a very small diameter. In the case of such thin monofilaments, such as are e.g. used for the production of toothbrushes, on applying the tensile stress between the storage reel and the processing station the initially taut monofilaments are drawn into the centre of the strand, while the overlong monofilaments spring to the outside. The heat applied to the strand consequently mainly acts on the outer or sprung-out monofilaments with an overlength, while the closely juxtaposed central monofilaments are only slightly influenced. As a result of this planned heat treatment of the exposed monofilaments and due to the cooling taking place over the further transport section and which can optionally be sped up by the additional cooling, the overlong monofilaments shrink.

As indicated hereinbefore, the fibres for processing to bristles are stretched after spinning and subsequently stabilized and wound up by hot air in a continuous process. In this state, the bristles are still heat-shrinkable, but in many cases this residual shrinkage can be accepted, whereas, in the case of top-quality bristles a complete or approximately complete elimination of shrinkability is sought, which is brought about by a longer lasting heat treatment at even higher temperatures, the bristles being wound onto spools, reels, etc. Thus, the molecular structure is fixed and the bristles lose their shrinkability. According to an advantageous procedural variant of the invention use is made of bristle strands of not or not completely stabilized monofilaments and after unwinding from the spools, the bristle strands are heated to the stabilization temperature.

As a result of this measure, stabilization is wholly or partly moved from bristle manufacture to bristle processing. As the monofilaments of the bristle strands located on the storage reel have not yet had their molecular structure fixed, they can be more strongly influenced during subsequent processing by correspondingly high heating and in particular greater shrinkage is possible, which, in turn, contributes to building up a corresponding tensile stress between the storage reels and the processing station. On the manufacturing side energy is saved and this can be used in optimum manner on the processing side.

The necessary tensile stress between the storage reels and the processing station can be applied in different ways. In particularly simple manner this is brought about in that the spools are continuously or in timed sequence decelerated against the holding force acting on the processing station, so that the overlengths are always only eliminated at the decisive point of the transport.

According to a further procedural variant the spools can be spooled back synchronously with the holding force acting on the processing station and/or can be moved away from the processing station. It is possible to store all or some of the storage reels on a common frame and the latter can be moved away from the processing station and then supplied again in accordance with the operating sequence time.

For the first time the inventive process makes it possible to house several multifilament bristle strands on one storage reel and to jointly remove same during processing. In order to ensure a taut tension for each bristle strand, deflection forces can act on the individual strand at right angles to their transportation movement. These deflection forces can be produced by rollers mounted on rockers, spring-loaded rollers or be weighted, roller-equipped sliders. The use of such deflection forces is naturally also possible when using spools with only one wound-on bristle strand.

According to the invention, preference is given to the use of twisted, multifilament bristle strands, with the number of twists per length unit being inversely proportional to the stiffness of the monofilament. The stiffness of the monofilament is determined by its cross-section (diameter) and by the plastics material used. According to the invention, the smaller the stiffness of the monofilament, the more the bristle strands are twisted. In practice, the following values have proved to be advantageous, the given number of twists being the minimum number per running metre:

| Bristle Diameter | Twists Per Running Meter |
|---|---|
| 0.10 to 0.19 mm | 4 |
| 0.20 to 0.39 mm | 3 |
| 0.40 to 0.49 mm | 2.5 |
| Higher than 0.50 mm | 1.5 |

The given minimum twist numbers can in particular be materialspecific increased. For example, polyethylene bristles require roughly twice as many twists per running metre as harder polystryrene bristles. Thus, for example, polypropylene bristles with a diameter of 0.20 mm have particularly few loops in a multifilament strand if there are more than 8 twists per running meter.

The optionally very highly twisted bristle strands also have this twisting effect at the processing station, so that when the bristles are fixed to the bristle carrier and after cutting to the desired length, they still in part retain this twist effect. For many bristle products, this twist effect of the bristles within the individual bundle has positive effects, particularly in the case of cleaning brushes. However, if such a twist effect is not desired, e.g. for toothbrushes or the like, it can be inventively eliminated in that the bristle strands are held at the processing station at a distance roughly corresponding to the desired final bristle length. As a result of this measure, the monofilaments spring back within the free-standing end of the bristle strand, because they are no longer fixed at the processing end. After fixing to the bristle carrier, optionally cutting the bristles to size behind the mounting support and release from the latter, the released bristle ends can spring back, so that the bristles of each bundle finally assume the desired parallel position.

Finally, it is advantageous if the bristle strands, drawn off tangentially from the spools, are led substantially linearly to the processing station. In particular, clamping effects, deflections, etc. between the storage reels and the processing station should be avoided, because they lead to loop formation as a result of different circumferential speeds of the monofilaments within a multifilament strand and due to different frictional forces.

According to another process variant, the bristle strands can be wound from the storage reels used after manufacture and under high tension onto the spools used for processing, accompanied by the simultaneous expansion of the shortest filaments in the bristle strand and the sprung-out monofilaments with overlength can be shrunk under heat action.

Thus, in this variant, the greatest overlengths resulting from manufacture can be eliminated in connection with the winding onto the processing spools, so that, in general, the aforementioned heat treatment can be eliminated during processing.

BRIEF DESCRIPTION OF THE DRAWINGS

The invention is described in greater detail hereinafter relative to non-limitative embodiments and the attached drawings, which show.

DETAILED DESCRIPTION OF THE PREFERRED EMBODIMENTS.

Figure 1:
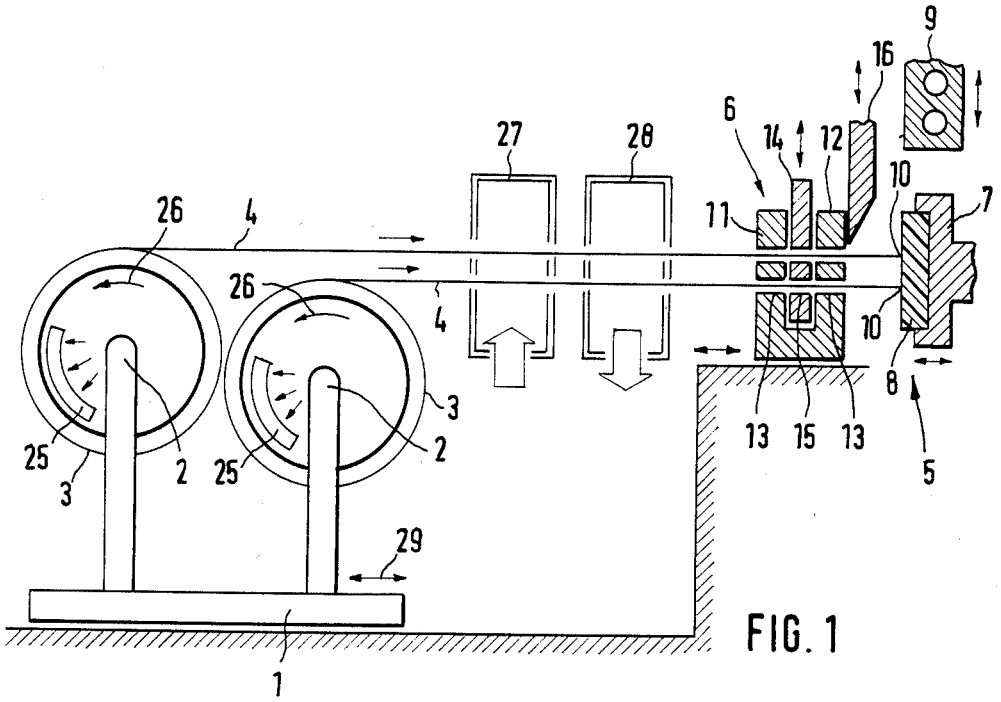
FIG. 1 a diagrammatic view of an apparatus for producing bristle articles.

The apparatus for producing bristle articles, e.g. brushes of all types shown in FIG. 1 has a frame 1, which receives several spools 3 mounted on horizontal spindles 2. An endless strand 4 of plastic bristle material is wound onto each spool. The apparatus also has a processing station generally designated by the reference numeral 5, on which are arranged a supply device generally designated by the reference numeral 6 for the endless strands 4 and a holder 7 for a plastic bristle carrier or body 8. A plurality of bristle bundles are to be fixed to the bristle carrier 8. This takes place by welding or melting in the illustrated embodiment. For this purpose, the processing station 5 carries a heating device 9, which can be vertically moved up and down and holder 7 is horizontally movable, so that the heating device 9 can be introduced between bristle carrier 8 and the leading ends of bristle strands 4 and both the bristle carrier 8 at the points 10 to be occupied by bristle bundles and the leading ends of the bristle strands 4 can be melted before the two are brought together.

The supply device 6 has successively arranged guide plates 11,12 with aligned guide channels 13 and a vertically displaceable clamping plate 14, which is also provided with guide channel 15. The supply device also has a cutting mechanism 6 for cutting in the desired manner the bristle bundles fixed to the bristle carrier 8.

The apparatus functions as follows. First, the bristle strands 4 are unwound from spools 3 and are threaded through the guide channels 13 of guide plate 11, with the guide channels 15 of clamping plate 14 aligned therewith and guide channels 13 of guide plate 12 until their leading ends are located in the fixing position. The clamping plate 14 is then raised and the bristle strands 4 are secured by the holding force produced. Heating device 9 is lowered, holder 7 being located in a position to the right of that shown in the drawing, so that the heating device 9 can be moved in front of the bristle carrier 8. In this position either simultaneously or successively the leading ends of the bristle strands 4 and the bristle carrier 8 are partly melted. After raising the heating device 9, the holder 7 moves on to the ends of the bristle strands 4 until the ends thereof are melted together with the bristle carrier 8. After the melt has solidified, the fixed bristles are cut off the bristle strands 4 by the cutting mechanism of the supply device 6. Clamping plate 14 is then lowered until guide channels 13 and 15 are aligned. The supply device 6 is then moved to the left in the drawing to the extent roughly corresponding to the bristle length. Clamping plate 14 is then again raised into the clamping position, so that the bristle strands 4 are again secured by the holding force. By moving the supply device 6 to the right, a tensile force is exerted on the bristle strands 4 and they are unwound from spools 3 until the leading ends, which project over the front guide plate 13 by the bristle length, are located in the position for melting. Thus, in synchronized manner the bristle carriers 8 are occupied with bristle bundles.

Figure 2:
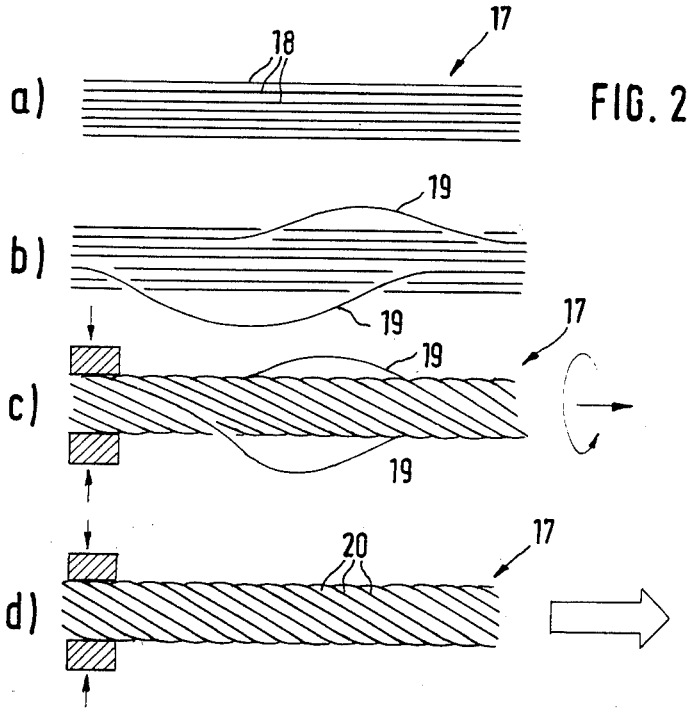
FIGS. 2(*a*) to (*d*) a diagrammatic view of in each case one portion of an endless bristle strand.

FIG. 2 shows portions 17 of bristle strands, FIG. 2(*a*) showing a strand with parallel monofilaments 18 in the manner of staple fibres. On winding up or unwinding such strands or during acceleration and deceleration, monofilaments always spring out of the union, as is shown with respect to monofilaments 19 in FIG. 2(*b*). These monofilaments 19 which have sprung or burst out of the strand cause difficulties at the supply device 6 of a processing station 5, as well as when fixing the bristles to the bristle carrier 8, leading to constant problems and therefore to operational interruptions. Less problems are caused by strands with twisted monofilaments 20, as shown in FIG. 2(*d*), because in this case the monofilaments are located within the strand in a stronger union. In conjunction with a powerful tensile force, as shown in FIG. 2(*d*) by the arrow in the direction of the strand, it is also possible to stretch such sprung-out monofilaments.

Figure 5:
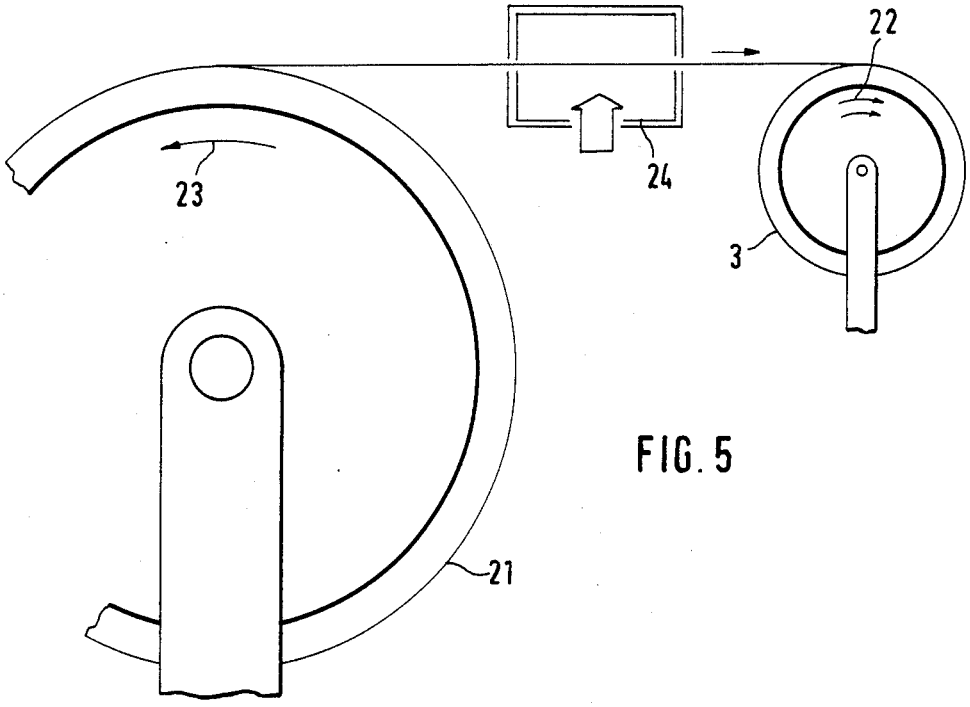
FIG. 5 a diagrammatic view of the apparatus for spooling the bristle strands.

In order to obtain a completely satisfactory bristle strand, it is initially possible to adopt the following procedure when spooling the strands onto the spools 3 (FIG. 1). After the monofilaments have been produced they are brought together to form a strand and the latter is wound on large storage reels 21 (cf. FIG. 5). From the storage reels the strands are then transferred to the actual working spools 3. This takes place under high tensile stress in that, while rotating spool 3 in the direction of the arrow 22, the storage reel 21 is strongly decelerated or is even driven in the reverse direction, as indicated by arrow 23. Thus, the shorter monofilaments in the strand are stretched, while the monofilaments with an overlength spring out of the strand, as indicated in FIGS. 2(*b*) and (*c*) These sprung-out monofilaments are shrunk on passing through a heating zone 24 and during the subsequent cooling, so that they are shortened to the length of the strand and are incorporated into the latter.

There are similar measures in connection with the processing of strands 4 (FIG. 1), in that, during the drawing off of strands 4, spools 3 are decelerated by the supply device 6, as indicated at 25, or the spools 3 are driven counter to the draw-off force, as indicated by arrows 26.

Instead of or in addition to the aforementioned measures on the path between spools 3 and supply device 6, the strands 4 can be passed through a heating zone 27 and a following cooling zone 28 in order to shrink any still remaining sprung-out monofilaments. The necessary tensile stress can also be produced in that the frame 1 receiving the spools 3 is movable in the direction of double arrow 29. On supplying the bristle strands 4 to the processing station 5, the frame initially moves in the same direction as the supply device 6 and prior to reaching the end position is moved in the opposite direction, so that strands 4 are tensioned.

Figure 3:
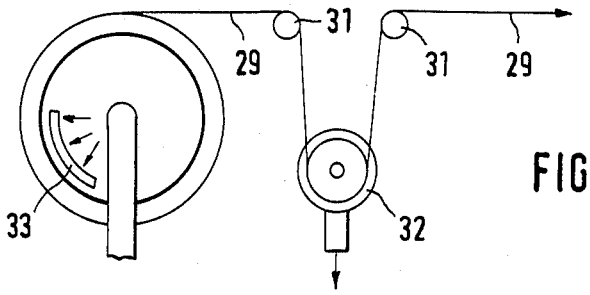
FIG. 3 a diagrammatic side view of part of an apparatus for processing several bristle strands wound onto a spool.
Figure 4:
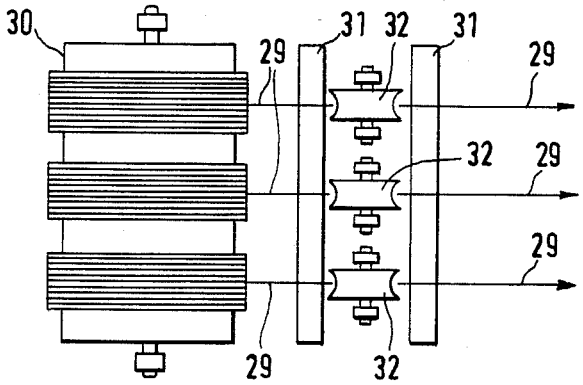
FIG. 4 a plan view with respect to FIG. 3.

Another embodiment for producing the necessary tensile stress is shown in FIGS. 3 and 4, with the embodiment being particularly advantageous if several bristle strands are wound in parallel onto a single spool 30. The bristle strands 29 are guided over pulleys 31 and deflected between the pulleys by sliders 32 to form loops. The necessary tensile stress is produced by a correspondingly high weight of sliders 32, which can optionally be assisted by a spring tension acting downwards in FIG. 3. Here again it is possible to additionally decelerate spool 3, as indicated at 33.

The aforementioned measures, such as the deceleration or spooling back of the spools 3, moving the spool frame 1, heating in zone 27 and cooling in zone 28 can obviously be provided individually or in combination.

What is claimed is:

1. A process for producing bristle articles from multifilament bristle strands wound as endless material onto spools, the process comprising the steps of: feeding the multifilament bristle strands to a processing station either in endless or cut to size form, fixing the multifilament bristle strands to a bristle carrier in the processing station by applying a holding or tensile force acting thereon in timed sequence at the processing station and accompanied by the unwinding from the spools, and, at least during holding cycles acting on the processing station, applying a tensile force directed counter to the holding force and acting between the spools and the processing station on all of the bristle strands, and adjusting said tensile force in such a manner that the multifilament bristle strands are stretched between the spools and the processing station.

2. A process according to claim 1, wherein the step of adjusting the tensile force directed counter to the holding force includes setting the tensile force in such a manner that all monofilaments within a multifilament bristle strand are tightened or stretched between the spools and the processing station.

3. A process according to claim 2, further comprising decelerating the spools in one of a continuously and timed sequence against the holding force acting on the processing station.

4. A process according to claim 6, wherein the step of decelerating the spools includes applying one of a counter spooling to the holding force acting on the processing station or moving the spools away from the processing station.

5. A process according to one of claims 1 or 2, wherein the step of adjusting the tensile force includes adjusting the tensile force in such a manner that when oppositely directed tensile forces act on the multifilament bristle strands, initially taut monofilaments are expanded.

6. A process according to claim 5, wherein the bristle strands are formed from not or not completely stabilized monofilaments, the process further comprising the step of heating the multifilament bristle strands after winding from the spools to a stabilization temperature.

7. A process according to claim 1, further comprising the steps of heating the bristle strands and at least outer monofilaments thereof after unwinding the bristle strands from the spools, and permitting a cooling of the bristle strands on further travel to the processing station.

8. A process according to claim 1, wherein each of said spools contains several multifilament bristle strands, the process further comprising subjecting each of the multifilaments bristle strands to a deflecting force acting at right angles to the monofilament bristle strand so as to stretch the same.

9. A process according to claim 1, wherein twisted, multifilament bristle strands are used and number of twists per length unit is inversely proportional to stiffness of the monofilament.

10. A process according to claim 9, wherein the number of twists is inversely proportional to a cross-section of the monofilament.

11. A process according to claim 1, wherein the multifilament bristle strands are held at the processing station at a distance from the processing end roughly corresponding to a desired final bristle length.

12. A process according to claim 1, wherein the step of feeding includes drawing the bristle strands tangentially from the spools and guiding the multifilament bristle strands substantially linearly to the processing station.

13. A process according to claim 1, the process further comprising the steps of winding the multifilaments bristle strands from storage reels under a high tension onto the spools, and simultaneously expanding the shortest monofilaments in the bristle strand and shrinking of sprung-out overlength monofilaments under a heat action.

* * * * *